US009277771B2

(12) United States Patent
Bakker et al.

(10) Patent No.: US 9,277,771 B2
(45) Date of Patent: Mar. 8, 2016

(54) PANTYHOSE WITH ASYMMETRICAL PANTY

(75) Inventors: Willem Bakker, Divonne (FR); Daniele Maggi, Castel Goffredo (IT); Maurice Perron, Autun (FR)

(73) Assignee: Invista North America S.a.r.l., Wilmington, DE (US)

( * ) Notice: Subject to any disclaimer, the term of this patent is extended or adjusted under 35 U.S.C. 154(b) by 81 days.

(21) Appl. No.: 13/576,409

(22) PCT Filed: Jan. 24, 2011

(86) PCT No.: PCT/US2011/022233
§ 371 (c)(1),
(2), (4) Date: Sep. 12, 2012

(87) PCT Pub. No.: WO2011/097088
PCT Pub. Date: Aug. 11, 2011

(65) Prior Publication Data

US 2013/0000014 A1 Jan. 3, 2013

Related U.S. Application Data

(60) Provisional application No. 61/300,661, filed on Feb. 2, 2010.

(51) Int. Cl.
*A41B 11/14* (2006.01)
*D04B 1/24* (2006.01)

(52) U.S. Cl.
CPC ..... *A41B 11/14* (2013.01); *D04B 1/243* (2013.01)

(58) Field of Classification Search
CPC ..... D04B 1/243; D04B 9/46; A41B 11/14
USPC ..... 2/61, 239, 240, 241, 242
See application file for complete search history.

(56) References Cited

U.S. PATENT DOCUMENTS

| | | | | | |
|---|---|---|---|---|---|
| 3,595,034 | A | * | 7/1971 | Safrit | 66/27 |
| 3,748,870 | A | * | 7/1973 | Fregeolle | 66/177 |
| 3,824,812 | A | * | 7/1974 | Matthews et al. | 66/177 |
| 5,465,594 | A | * | 11/1995 | Imboden et al. | 66/177 |
| 5,787,512 | A | * | 8/1998 | Knox | 2/409 |
| 6,055,674 | A | | 5/2000 | Imboden et al. | |
| 6,457,185 | B1 | * | 10/2002 | Frazier | 2/239 |

FOREIGN PATENT DOCUMENTS

| | | | |
|---|---|---|---|
| JP | 08-291402 | A | 11/1996 |
| JP | 2002-212802 | A | 7/2002 |
| JP | 2002212802 | * | 7/2002 |
| TW | 362374 | | 6/1999 |

OTHER PUBLICATIONS

International Search Report issued to PCT/US2011/022233, mailed Oct. 25, 2011.

International Preliminary Report on Patentability issued to PCT/US2011/022233, mailed Aug. 7, 2012.

* cited by examiner

*Primary Examiner* — Richale Quinn
(74) *Attorney, Agent, or Firm* — Bridget Sciamanna

(57) ABSTRACT

The invention provides hosiery including a panty portion that is asymmetrical. The hosiery provides a comfortable fit for a variety of different sizes including larger sizes and maternity.

12 Claims, 1 Drawing Sheet

PANTYHOSE WITH ASYMMETRICAL PANTY

BACKGROUND OF THE INVENTION

1. Field of the Invention

Disclosed are pantyhose suitable for an expanded size range such as for plus-sizes and maternity which are knitted to include a panty wherein the front and back portions have different dimensions.

2. Description of Related Art

Plus-size is a generic term for apparel targeted to larger individuals (for example, women over size 14 and men over size XL.) In the United States, over 30% of the total consumer base can be characterized as plus-sized, growing at a rate of 2% per year. Similarly, in Europe, there is an average of 23% of consumers characterized as plus-sized, lead by the United Kingdom with a 47% of the female population above size 14, followed by Germany at 29%. This size group is rapidly increasing in developing countries, such as China and Brazil at a rate of about 5% per year.

Plus-sized women have difficulty finding acceptable hosiery garments, i.e., pantyhose. Currently available hosiery garments are frequently unattractive with built in panels and/or cause the wearer discomfort. The result is that many women in this size range choose to wear pants/trousers rather than wearing pantyhose.

SUMMARY OF THE INVENTION

The pantyhose of some aspects provides a solution to the unattractive and uncomfortable features of currently available plus-sized hosiery. The pantyhose of some aspects eliminates the need for extra panels by knitting separate leg portions to form asymmetrical tubes which, when assembled, provide a front panty portion of the hosiery of a different area than the back panty portion. This provides hosiery that accommodates differently shaped women who may have a larger posterior region, or if pregnant, a larger tummy.

In one aspect is an article including pantyhose, the pantyhose including:

(a) a right leg portion including a right panty portion at a top end and a right toe portion at an opposite end; and (b) a left leg portion including a left panty portion at a top end and a left toe portion at an opposite end;

wherein each of the right leg portion and the left leg portion each form an asymmetrical tube;

the right panty portion has a front and back;

the left panty portion has a front and back; and the front of the right panty portion and the front of the left panty portion have a different fabric construction than said back of the right panty portion and the back of the left panty portion, respectively.

In another aspect is a method for preparing pantyhose including:

(a) knitting a right leg portion including a right panty portion;

(b) separately knitting a left leg portion including a left panty portion; and (c) attaching the right leg portion and the left leg portion;

wherein each of the right leg portion and the left leg portion each form a tube;

the right panty portion has a front and back;

the left panty portion has a front and back; and the front of the right panty portion and the front of the left panty portion have a different fabric construction than the back of said right panty portion and the back of the left panty portion, respectively.

DETAILED DESCRIPTION OF THE INVENTION

As used herein, the term "spandex" means a manufactured filament in which the filament-forming substance is a long chain synthetic polymer comprised of at least 85% by weight of a segmented polyurethane. A variety of different spandex compositions are useful with the pantyhose of some aspects such as polyether and co-polyether based spandex, among others. Specific examples of commercially available spandex yarns include those available under the tradenames LYCRA® 162B and LYCRA®902C available from INVISTA S.àr.l. of Wichita, Kans.

As used herein, the term "asymmetrical" as applied to the leg tubes or to the panty portion of the tubes or the panty portion of the pantyhose means that a different fabric construction is used to provide the front and back of each panty.

Figure 2:
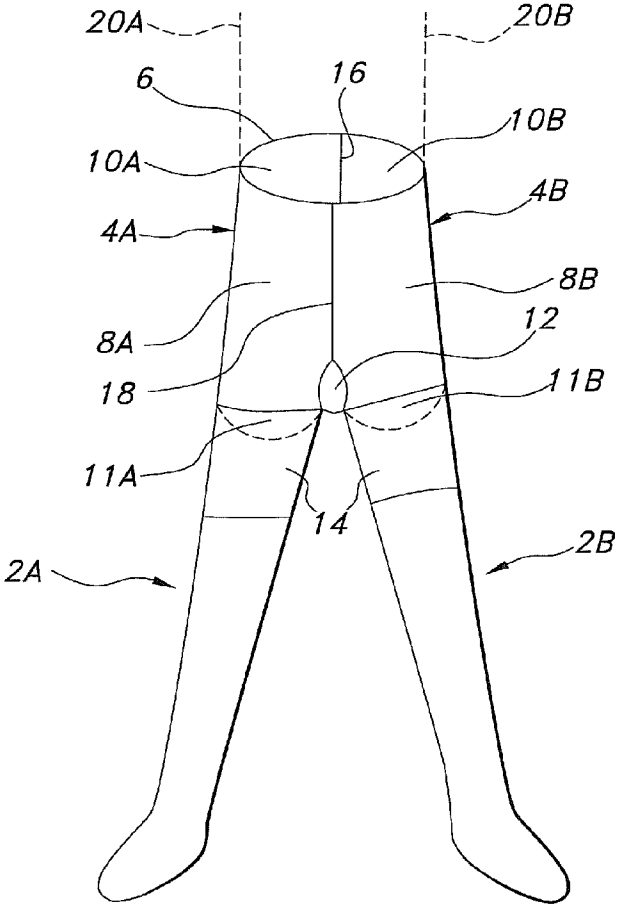
FIG. 2 shows the finished pantyhose article.

The pantyhose article of some aspects is knitted from two separate tubes which are attached to form the finished pantyhose. The two tubes may be attached in any suitable manner such as by sewing. The points of attachment in FIG. 1 are shown in the front (18A, 18B) and in the back (16A, 16B) and correspond to the seams (16, 18) shown in FIG. 2 for the finished pantyhose article.

Figure 1:
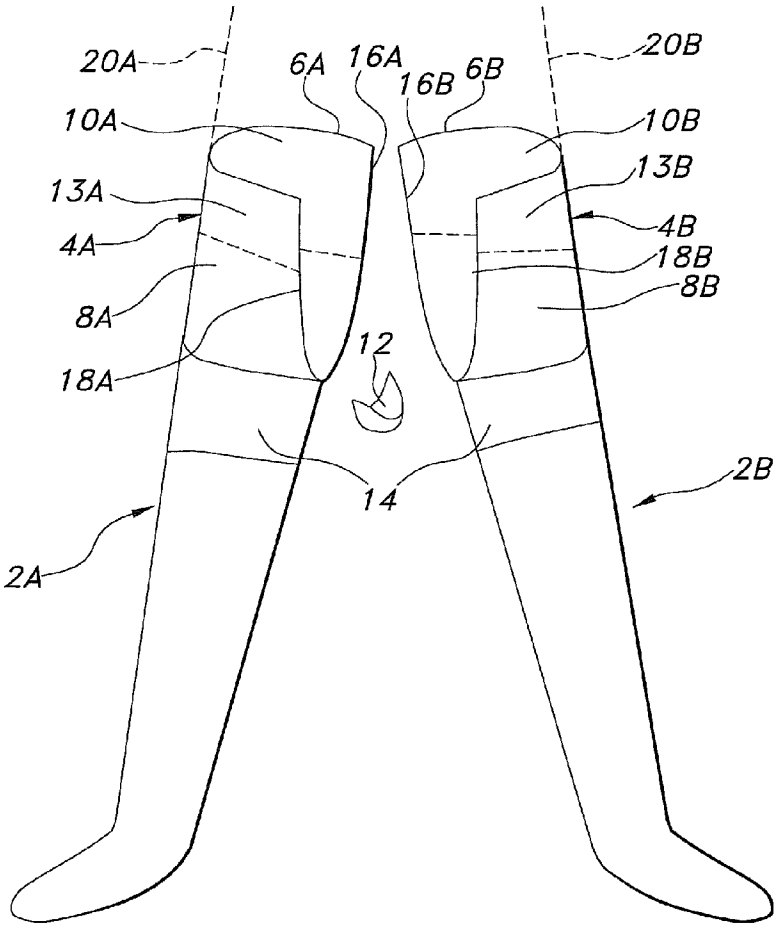
FIG. 1 shows the components of the pantyhose article.

Referring to FIG. 1, the asymmetrical tubes corresponding to a right leg portion 2A and a left leg portion 2B are shown. The right leg portion 2A includes a right panty portion 4A at a top end and a right toe portion 22A at the opposite end and the left leg portion 2B includes a left panty portion 4B at a top end and a left toe portion 22B at the opposite end. The right panty portion 4A has a front 8A and back 10A and the left panty portion 4B has a front 8B and back 10B. The front (8A, 8B) and back (10A, 10B) define the asymmetric portions as they have different areas of compression due to the differing yarn/fabric construction that eliminate the need for additional panels. By asymmetric, it is meant that the front portions (8A, 8B) have a different fabric construction or otherwise are not identical to the back portions (10A, 10B) on either side of the central lines (20A, 20B) as shown. Central lines (20A, 20B) represent an invisible line between the front and back portions of the assymetrical tubes which would otherwise represent a line of symmetry. This is accomplished by having a back (10A, 10B) of yarns providing lower compression than the front (8A, 8B) for plus-sized pantyhose or by having a lower compression in the front (8A, 8B) for maternity pantyhose.

The waistband (6A, 6B) of the pantyhose may include any suitable construction. To prevent or reduce rolling of the waistband, it may include a construction other than a folded over waistband and may include a single layer of fabric. To further reduce rolling of the waistband, the panty portion (4A, 4B) may be designed to extend above the waist of the wearer (not shown).

The pantyhose may include any suitable combination of elastic or elastomeric yarns with hard yarns. The elastomeric yarn may be included in every course or in alternate courses (other constructions may be useful where a patterned hosiery is desired). One suitable elastomeric yarn is spandex which may be used bare or covered. Examples of hard yarns include polyamide yarns such as nylon 6, nylon 6/6, nylon 10, nylon 12, nylon 6/10, nylon 6/12, and combinations thereof. The hard yarns may be flat or textured. The pantyhose may include yarns selected from polyamide covered spandex yarns and blends of polyamide covered spandex yarns with polyamide yarns.

To further enhance the comfort of the wearer, the panty portion of the hosiery may only include sheer yarns, and thus have reduced compression. The reduction or elimination of compression is achieved by the use of sheer yarns or lighter denier yarns and also may be achieved by reduction in spandex fiber content in the panty portion. The front and back of the panty may include different yarns which vary the compression either between the front and the back, or alternatively, in a portion of the front or back. For example, yarns in the bottom of the panty portion (4A, 4B) closest to the crotch 12 may provide less compression than the yarns near the waistband 6. The yarn/fabric construction can vary depending on the desired compression effect. The top rows (13A, 13B—shown in FIG. 1) (closest to the waistband 6) may have different yarns than the bottom rows (11A, 11B—shown in FIG. 2) (closest to the crotch 12) for either the front of the panty portion (8A, 8B) or the back of the panty portion (10A, 10B). This may be for the top 50% to about 90% of the top rows, including about 70% to about 85% of the top rows of the panty portion. The bottom rows (11A, 11B—shown in FIG. 2) may optionally include yarns having higher denier or provide a heavier weight fabric to provide additional support at that location of the garment.

Suitable amounts of spandex fiber may be about 10% to about 30% by total yarn weight, including about 12% to about 26%; and about 15% to about 22%.

To provide additional comfort the left leg portion and the right leg portion may include yarns that have the same denier or a heavier denier than yarns in the left panty portion and the right panty portion. By contrast, the leg portions (left and right) may have a construction selected from the group consisting of sheer, semi-opaque, and opaque. To further enhance comfort and reduce soreness during wear, the right leg portion and the left leg portion each may include an upper thigh portion 14 where the upper thigh portion includes reinforcing yarns.

The features and advantages of the present invention are more fully shown by the following examples which are provided for purposes of illustration, and are not to be construed as limiting the invention in any way.

EXAMPLES

The pantyhose of some aspects is prepared using any suitable hosiery machine such as a hosiery knitting machine with 400 needles, 32 gauge, using the standard four feed system.

Examples for fiber content and construction include:

Sheer:

spandex %=26%

Polyamide %=74%

PANTY YARNS=spandex fiber of 45 dTex covered with 18 filament/6 dTex textured polyamide yarn in alternate courses with 16 filament/10 dTex textured polyamide yarn LEG YARNS=spandex fiber of 45 dTex covered with 18 filament/6 dTex textured polyamide yarn in alternate courses with 33 filament/20 dTex flat polyamide yarn Semi-Opaque spandex %=22%

Polyamide %=78%

PANTY YARNS=spandex fiber of 45 dTex covered with 18 filament/6 dTex textured polyamide yarn in alternate courses with 16 filament/10 dTex textured polyamide LEG YARNS=spandex fiber of 45 dTex covered with 18 filament 6 dTex textured polyamide yarn in alternate courses with 44 filament/34 dTex textured polyamide yarn Opaque spandex %=12%

Polyamide %=88%

PANTY YARNS=spandex fiber of 45 dTex covered with 18 filament/6 dTex textured polyamide yarn in alternate courses with 16 filament/10 dTex textured polyamide yarn LEG YARNS=spandex fiber of 45 dTex covered with 18 filament/6 dTex textured polyamide yarn (Feed 1,3) plated with 33 filament/20 dTex textured polyamide yarn in alternate courses with 33 filament 20 dTex textured polyamide yarn (Feed 2,4)

The panty portion was altered by using the following yarn in the bottom 15% of the rows in the back panty portion:

Spandex fiber covered with 18 filament/6 dTex flat yarn, plated with 22 filament/7 dTex flat yarn (Feed 1,3).

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention.

The invention claimed is:

1. An article comprising pantyhose, said pantyhose comprising (a) a right leg portion including a right panty portion at a top end and a right toe portion at an opposite end; and (b) a left leg portion including a left panty portion at a top end and a left toe portion at an opposite end;

wherein:

each of the right panty portion and the left panty portion have a bottom that includes yarns and wherein different yarns are present in the bottom 15% of rows of each of the back of the right panty portion and the back of the left panty portion;

each of said right leg portion and said left leg portion each form an asymmetrical tube;

said right panty portion has a front and back, wherein:

said front of said right panty portion does not include an additional panel; and said back of said right panty portion does not include an additional panel;

said left panty portion has a front and back, wherein:

said front of said left panty portion does not include an additional panel; and said back of said left panty portion does not include an additional panel; and said front of said right panty portion and said front of said left panty portion have a different knitted fabric construction and different areas of compression than said back of said right panty portion and said back of said left panty portion, respectively.

2. The article of claim 1, further comprising a crotch panel located between the right leg portion and the left leg portion where the panty portion begins.

3. The article of claim 1, wherein said pantyhose further comprises a waistband that is a single layer of fabric at the top end of the panty portion.

4. The article of claim 1, wherein said left panty portion and said right panty portion include sheer yarns.

5. The article of claim 1, wherein said left leg portion and said right leg portion include yarns that have the same denier or a heavier denier than yarns in said left panty portion and said right panty portion.

6. The article of claim 1, wherein said left leg portion and said right leg portion have a construction selected from the group consisting of sheer, semi-opaque, and opaque.

7. The article of claim 1, wherein said pantyhose include yarns selected from polyamide covered spandex yarns and blends of polyamide covered spandex yarns with polyamide yarns.

8. The article of claim 1, wherein said right leg portion and said left leg portion each comprise an upper thigh portion and said upper thigh portion includes reinforcing yarns.

9. The article of claim 1, wherein:

each of the right panty portion and the left panty portion have a top that includes yarns and wherein different yarns are present in the top 50% to about 90% of rows of each of the right panty portion and the left panty portion.

10. The article of claim 1, wherein the yarns present in the bottom have a higher denier or provide a heavier weight fabric at that location.

11. A method for preparing the article comprising pantyhose according to claim 1, comprising:

(a) knitting the right leg portion including the right panty portion;

(b) separately knitting the left leg portion including the left panty portion; and (c) attaching said right leg portion and said left leg portion.

12. The method of claim 11, wherein said attaching is effected by sewing.

* * * * *